United States Patent [19]

Sugimoto

[11] Patent Number: 4,470,219

[45] Date of Patent: Sep. 11, 1984

[54] TOY VEHICLE ASSEMBLY

[75] Inventor: Katsuhiro Sugimoto, Kashiwa, Japan

[73] Assignee: Takara Co., Ltd., Tokyo, Japan

[21] Appl. No.: 549,050

[22] Filed: Nov. 7, 1983

Related U.S. Application Data

[63] Continuation of Ser. No. 334,659, Dec. 28, 1981, abandoned.

[30] Foreign Application Priority Data

Dec. 25, 1980 [JP] Japan ..... 55-187059

[51] Int. Cl.[3] ..... A63H 17/00

[52] U.S. Cl. ..... 446/464; 446/471

[58] Field of Search ..... 46/206, 209, 201, 202, 46/221, 222, 223, 208

[56] References Cited

U.S. PATENT DOCUMENTS 3,918,198 11/1975 Cheng et al. ..... 46/206

FOREIGN PATENT DOCUMENTS 960859 1/1975 Canada ..... 46/206
1157188 5/1958 France ..... 46/209
1342973 12/1963 France ..... 46/221

*Primary Examiner*—Mickey Yu
*Attorney, Agent, or Firm*—Jackson, Jones & Price

[57] ABSTRACT

The miniature vehicle toy is provided having a wheel assembly, a chassis member, a prime mover assembly and a body member. The wheel assembly can be fastened to the chassis member by the snap-mounting of the prime mover assembly between a keeper member and pawl member that are integrally molded onto the chassis member.

5 Claims, 4 Drawing Figures

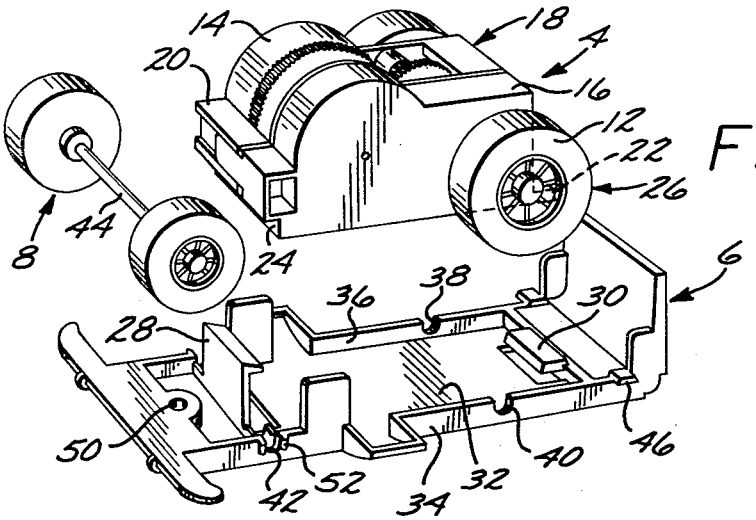
FIG. 1
FIG. 2
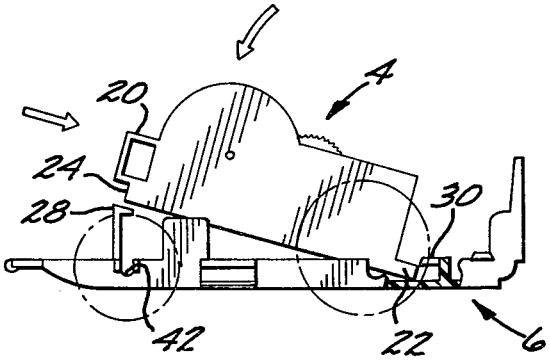
FIG. 3
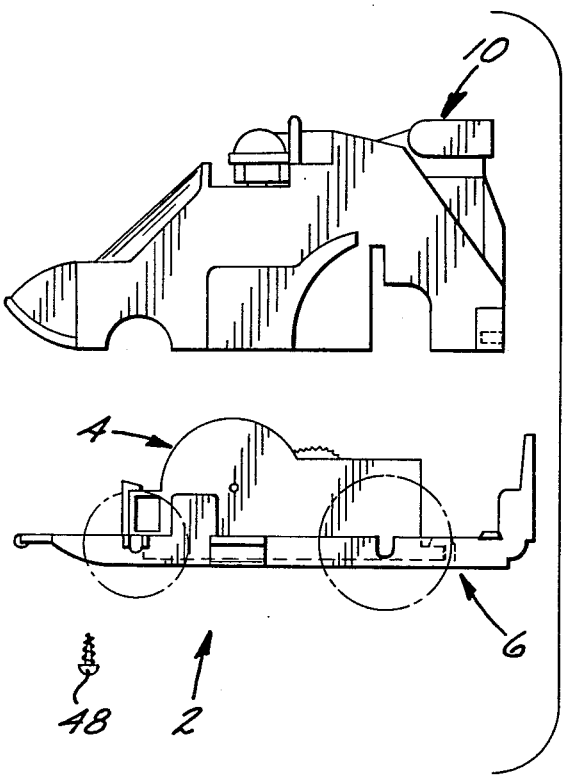
FIG. 4
PRIOR ART
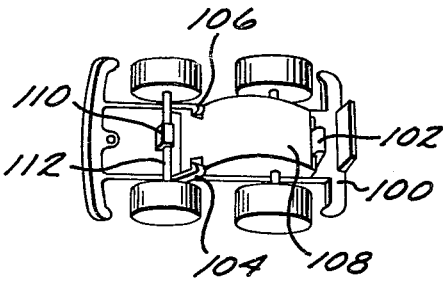

TOY VEHICLE ASSEMBLY

This is a continuation of application Ser. No. 334,659, filed Dec. 28, 1981 now abandoned.

BACKGROUND OF THE INVENTION

1. Field of the Invention

The present invention is directed to the toy field and more particularly, to a small spring powered toy vehicle that can be economically assembled.

2. Description of the Prior Art

Miniature toy vehicles are well known in the toy industry and are favorite play objects of children. The competition to provide such toys is intense and economic factors weigh heavily on the success of any particular toy vehicle. A major consideration is the high labor costs associated with assembling a toy vehicle. The demands to lower the production cost of a toy vehicle versus the necessity to provide a quality product has been a constant burden upon the toy manufacturers in the prior art.

Various examples of providing toy vehicle designs to facilitate economical assembling can be found such as in U.S. Pat. No. 4,183,173, and the French Pat. No. 1,275,450.

The prior art is still seeking an optimum configuration for a toy vehicle that can be economically manufactured while providing a relatively durable toy that can withstand the rigors of childs play.

SUMMARY OF THE INVENTION

The present invention provides a vehicle toy that can be formed from four main component parts. A chassis member is integrally molded from a synthetic resin plastic and is specifically designed to support a prime mover assembly. A front wheel assembly is captured between the prime mover assembly and the chassis member and finally a subjectively designed vehicle body member is attached to the chassis member.

The chassis member can include an integrally molded keeper member provided adjacent the upper rear surface of the chassis member and extending substantially parallel to this surface and a pawl member provided adjacent the upper front of the chassis member and extending upward from the horizontal surface of the chassis member. The prime mover assembly can be a combination gear transmission and spring motor having a rear wheel assembly affixed thereto. The front portion of the prime member assembly housing can have a first locking member complimentary to the pawl member while the rear surface of the housing member can have a second locking member complimentary to the pawl member. The chassis member can include a recess extending across its upper surface for receiving a front wheel assembly axle. The prime mover assembly has a complimentary recess to thereby lock in the front wheel assembly when the prime mover is snap-fitted into the chassis member. The prime mover assembly is mounted so that the second locking member is slid underneath the keeper member and then the prime mover assembly is pivoted about the keeper member to provide a snap-locking fit with the pawl member at the front of the chassis member. During the insertion of the prime mover into this locking relationship, both keeper and pawl members are relatively moved in an initial resilient flexing to accomodate the insertion. This relative movement can be facilitated by the design of the chassis member along its longitudinal axis from front to rear to permit a degree of bending or flex during the insertion of the prime mover housing.

The features of the present invention, which are believed to be novel are set forth with particularity in the pending claims. The present invention, both as to its organization and manner of operation, together with further objects and advantages thereof, may best be understood by reference to the following description, taken in conjunction with the accompanying drawing.

BRIEF DESCRIPTION OF THE DRAWINGS

FIG. 1 is a schematic exploded view of the preferred embodiment of the invention;

FIG. 2 is a side-elevational view of the prime mover and chassis;

FIG. 3 is an exploded side-view of the frame and assembled chassis member; and

FIG. 4 is a perspective schematic view of a prior art assembly.

DETAILED DESCRIPTION OF THE PREFERRED EMBODIMENT

The following description is provided to enable any person skilled in the toy industry to make and use the invention, and it sets forth the best mode comtemplated by the inventor of carrying out the invention. Various modifications, however, will remain readily apparent to those skilled in the above art, since the generic principals of the present invention are applied herein specifically to provide a relatively economical and easily manufactured miniature toy vehicle.

As can be seen in FIG. 3, the entire toy miniature vehicle, 2, can be considered to consist of four major component parts; a primary mover assembly 4, a chassis member 6, a front assembly 8, and a subjectively configured body member 10.

The prime mover assembly 4 can comprise a multi-geared transmission and a coil spring that are connected to a rear wheel assembly 12 that is rotably mounted to and extends through housing shells 14 and 16. The shells 14 and 16 connect together to form the motor housing member 18. A first locking member 20 is formed on a front projection extending forward of the housing member 18. The locking surface is the upper surface of member 20. A second locking member 22 extends rearward of the housing member 18 and its locking surface is also the upper surface of member 22. A recess 24 extends across and beneath the first locking member 20.

The prime mover assembly 4 is basically self-contained and when inserted within the chassis member 6, permits the winding of the spring motor by the rearward movement of the toy vehicle 2. The gear assembly is such that when the rear wheel 12 is moved in a clockwise direction, as shown in the drawings, a gear ratio is provided through a pair of floating gears that permits the storing of spring energy. When the toy vehicle 2 is subsequently released, a different gear ratio is provided to permit an extensive drive of the toy vehicle by the spring energy with the rear wheel assembly 26 driven in an opposite direction.

The chassis member 6 has an elongated configuration and is preferrably formed from a molded plastic resin. The specific dimensions of the chassis member 6 are such that a degree of flex or bend is permitted along the length or longitudinal axis of the chassis member 6. Adjacent the front end of the chassis member 6 is an upwardly extending pawl member 28 that has a locking head configuration. Adjacent the rear end of member 6 is a keeper member 30 that extends forward and is substantially parallel to the bottom upper surface 32 of the chassis member 6 and is raised a small distance above the plane of this surface. Guiderails 34 and 36 extend along the adjacent sides of the chassis member 6 and are substantially spaced apart to be slightly greater than the width of the prime mover assembly 4. Appropriate notches 38 and 40 can be provided in the respective guiderails 34 and 36 to accomodate the rear axle of the rear wheel assembly 26. An additional set of notches that can be collectively referred to as element 42 are also provided in the respective guiderails 34 and 36 to accommodate the axle 44 of the front wheel assembly 8. Spacer members 52 can be provided for contacting the inside surface of the wheel drums of the front wheel assembly for providing a more precise alignment of the front wheel assembly 8.

Finally, a mounting notch or ledge 45 can be provided on either side of the rear surface of the chassis member 6 to provide a locking interface with the body member 10.

The chassis and motor combination of a conventional miniature toy vehicle is shown in the prior art embodiment of FIG. 4. The chassis is integrally molded of a synthetic resin and is provided with a rear keeper member 102 and a pair of catching pawls 104 and 106 for an appropriate mounting of the prime mover assembly 108. An individual holding member 110 of an inverted L-shaped cross-sectional configuration is provided on the front of the chassis 100. The holding member 110 is designed to permit a snap-mounting of a front axle 112 into the holding member 110. Problems have occured when this structure is attempted to be incorporated into a relatively miniature toy vehicle having a length of approximately 5 cm.

The present invention eliminates these problems and provides component parts for a miniature toy vehicle that are readily adapted for an economical manufacturing and assembling.

As can be seen in FIG. 2, the second locking member 22 of the prime mover assembly is slid underneath the keeper member 30 on the chassis member 6. Since the width of the prime mover assembly 4 is within the guiderails 34 and 36, it is a simple matter to tip the prime mover assembly 4 during assembly and rearwardly slide the locking member 22 underneath the keeper member 30. Prior to the insertion of the prime member assembly 4 onto the chassis member 6, a front wheel assembly 8 is positioned to rest within the forward notches 42. The subsequent pivotal movement of the prime mover assembly 4 downward causes the front surface of the locking member 20 to contact the locking head of the pawl member 28 and to cam or pivot forward. The resiliency of the chassis member 6 facilitates this insertion movement. When the upper edge of the front surface of the locking member 20 clears the locking head of the pawl 28, to pawl snaps back to effectively lock the prime mover assembly 4 onto the chassis member 6. In this position, the recess 24 which extends across the front underside of the prime mover assembly 4, is positioned across the front axle 44 and locks the front wheel assembly 8 onto the chassis member 6 includes a recess opening beneath the pawl member 28 and also a recess opening beneath the keeper member 30. The recess opening beneath the pawl member 28 is positioned beneath the axle of front wheel assembly. Subsequently, a body member 10, i.e., in the configuration of a Grand Prix racing car, can be mounted onto the chassis member 6 by interlocking with the mounting ledge or notches 46 and the insertion of a screw 48 through a mounting bore 50 in the chassis member 6.

As can be readily appreciated, the chassis member 6 can be varied in configuration within the purposes of the present invention to accommodate different forms of vehicle bodies. Additionally, the specific keeper members and pawl members can be varied in their structural designs as long as they are mounted to permit a relative movement to accommodate the insertion of the prime member assembly. The one-step mounting of the prime member assembly and the locking of the front wheel assembly speeds up the production process and eliminates the potential for manufacturing error.

As can be readily appreciated, the miniature toy vehicle of the present invention can accommodate many different modifications and adaptations of the above described preferred embodiment by a person skilled in the art without departing from the spirit and scope of the present invention. Therefore, it is to be understood that, within the scope of the appended claims, the invention may be practiced other than specifically described above.

What is claimed is:

1. In a toy in the form of a miniature vehicle, the improvement comprising:

a simulated vehicle body member;

a relatively flexible chassis member integrally molded from a plastic resin having a substantially horizontal surface and including a pawl member extending upward and adjacent the front of the chassis member, a keeper member adjacent the rear of the chassis member extending substantially parallel to the surface of the chassis member at a position closer to the horizontal surface than the pawl member and a pair of side guiderails extending above the surface and between the pawl and keeper members;

a front wheel assembly including a pair of wheels interconnected with an axle mounted on the chassis member; and a prime mover assembly mounted on the chassis member between the side guiderails including a housing member, a rear wheel assembly with an axle member and a spring motor connected to the rear wheel assembly, the housing member further includes a front first pawl locking member complementary to the pawl member and a rear second keeper locking member, the first and second locking members are positioned on the prime mover assembly at different heights such that the insertion of the prime mover assembly into a locking relationship with the chassis pawl and keeper members causes an initial resilient flexing of the chassis member to accommodate the insertion with a relative pivotal movement occurring between the prime mover assembly and the keeper member during insertion, the chassis member further having only one mounting bore at one end to accommodate a singular fastener for securing the body member and interlocking means at the other end for co-acting with the vehicle body member so that the above vehicle component members and assemblies can be finally assembled with only one separate fastener.

2. The invention of claim 1 further including a recess across the chassis member beneath the axle of the rear wheel assembly.

3. The invention of claim 2 further including means in the prime mover assembly housing member for locking the front wheel assembly to the chassis member.

4. The invention of claim 3 wherein the locking means in the housing member includes a recess extending across the underside of the housing member.

5. The invention of claim 1 further including a plurality of notches in the guiderails to respectively receive the front and rear axles.

* * * * *